United States Patent [19]

Eschenberg et al.

[11] 4,218,212

[45] Aug. 19, 1980

[54] REFRACTORY FRONT WALL FOR INDUSTRIAL FURNACE

[75] Inventors: Rudolf Eschenberg; Herbert Schäfer, both of Dinslaken, Fed. Rep. of Germany

[73] Assignee: Thyssen Aktiengesellschaft Vorm. August Thyssen-Mütte, Duisburg, Fed. Rep. of Germany

[21] Appl. No.: 956,732

[22] Filed: Nov. 1, 1978

[30] Foreign Application Priority Data

Nov. 5, 1977 [DE] Fed. Rep. of Germany ..... 2749590

[51] Int. Cl.[2] ..... F27D 1/00; F27D 1/08

[52] U.S. Cl. ..... 432/247; 110/336; 110/339; 432/249

[58] Field of Search ..... 432/247, 249; 110/336, 110/338, 339

[56] References Cited

U.S. PATENT DOCUMENTS

| | | | |
|---|---|---|---|
| 2,699,740 | 1/1955 | Weber | 432/249 X |
| 2,992,514 | 7/1961 | Couch et al. | 432/249 |
| 3,327,445 | 6/1967 | Rhone et al. | 110/336 |
| 4,053,278 | 10/1977 | Fleischmann et al. | 432/247 |

FOREIGN PATENT DOCUMENTS

| | | | |
|---|---|---|---|
| 2601002 | 7/1977 | Fed. Rep. of Germany | 432/247 |

*Primary Examiner*—John J. Camby
*Attorney, Agent, or Firm*—J. Harold Nissen

[57] ABSTRACT

Refractory vertically extending front wall for industrial furnaces which is suspended at its upper end. The refractory front wall includes several vertical individual segments which are mounted by shifting towards each other in a direction transverse to the axis of the furnace, whereby the adjacent individual segments intermesh by means of a groove/tongue arrangement.

8 Claims, 3 Drawing Figures

REFRACTORY FRONT WALL FOR INDUSTRIAL FURNACE

The invention relates to a refractory front wall for industrial furnaces which is suspended at its upper end. Such a construction of front walls is selected when the passage of hot material is to be guaranteed at the lower end of the front wall. Such a construction is particularly necessary with an ignition hood for a sintering belt in order to allow the passage of the sinter bed. Such constructions are also useful in pusher type furnaces for the passage of ingots. A construction of a front wall generally used in practice for a sintering belt is described in the German Offenlegungsschrift No. 1,901,096. In this usual construction the front walls or front face walls are inclined. This construction discloses a series of disadvantages. The front walls are fixedly connected with the remaining part of the ignition hood and comprehensive steps are necessary in repair work. The curved construction prevents the anchored bricks from expanding. High edge pressures and spalling of the bricks can result. In the case of large hoods there is also the danger of the steel construction bending which causes damages in the bricks. At the beginning of the sixties the proposal also became known to construct the front walls vertically (German Pat. No. 1,130,181). In this construction the vertical front wall is suspended at its upper end on a carrier unit by means of a metal frame 27. The metal frame extends to the lower end and has water cooled tubes on the lower end. This construction did not find access into practice to the applicant's knowledge. This may be due to the effect that the arrangement of cooling tubes does not have any durability in the area of the hot sinter which shows intensive thermal reactions after the ignition. Thus, the ignition hood must be run cold in each case when smaller damage is at hand which results in long periods of inoperation and repair.

Starting from the aforementioned prior art, the object of the present invention is to develop a refractory front wall which has a longer durability and is quickly repairable in case of damage.

This object is solved according to the invention in that the refractory front wall is composed of several vertical individual segments which are mounted by shifting towards each other in direction transverse to the axis of the furnace, whereby the adjacent individual segments intermesh by means of a groove/tongue arrangement. Depending on the size of the ignition hood 5 to 15 individual segments, for example, are provided over the width of the front wall. The individual segments lying adjacent each other in a transverse direction to the axis of the furnace have one or several groove/tongue arrangements which for expedience extend vertically and prevent gas from passing between the individual segments. It has shown that a vertical groove/tongue arrangement is in itself sufficient for ignition hoods since, as is known, a slight underpressure is present in ignition hoods.

The individual segments which can be shifted transversely towards each other have the advantage that when damage occurs only the respective individual segment need be exchanged. It is not necessary here that the furnace is run cold. A new segment can be run quickly into the damaged place. In order to permit this quick exchange, it is particularly expedient to construct the individual segments so that they are equal and can be interchanged. It is further expedient to suspend the individual segments on a transverse carrier unit by means of a roll. In the case of specific constructions of industrial furnaces, e.g. in pusher type furnaces, it is desirable to also allow the refractory front wall to be lifted and lowered vertically in order to permit the passage of ingots after heating. A corresponding effect applies for an ignition hood when a different height of sinter bed is being worked with. The vertical lifting and lowering is preferably achieved by means of the joint transverse carrier unit.

The individual segments can be produced in one piece from a refractory concrete. Refractory concretes are known today which have such a high tensile strength that it is only necessary to anchor (suspend) the individual segment at its upper part. Refractory concretes with a high temperature bending strength of at least 11.2 $N/mm^2$ at 1200° C., or at least 5.1 $N/mm^2$, are recommended for such working materials. The chemical composition of such refractory concretes is, for example, as follows: 93–94% $Al_2O_3$, 4.5–5% $SiO_2$, 1.0–1.2% $TiO_2$, 0.4% CaO, traces of $Fe_2O_3$.

However, what is preferred is a construction in which each individual segment has a metallic holding rod which extends into the foot portion of the refractory front wall, said holding rod having an anchor segment on its lower end for anchoring the refractory front wall. The holding rod extending into the foot portion guarantees better durability. This construction is particularly advantageous if the foot portion of the refractory front wall is built up by bricks high temperature bending strength attached on the anchor segment, whereas the remaining upper part of the refractory wall is composed of usual refractory bricks, preferably light-weight refractory bricks, arranged one above the other which lie on the foot portion in vertical direction and are held by the holding rod in horizontal direction. This construction has a series of advantages. It is firstly essential that none of the bricks is subjected to shearing. The usual refractory bricks arranged one above the other lie (due to the force of gravity) on the high-quality refractory bricks (bricks with a high bending strength of at least 11.2 or 5.1 $N/mm^2$ at 1200° C. and 1300° C. respectively, so that the main load is taken over by the high-quality material, the anchor segment and the holding rod. It is not necessary that the anchoring is achieved in horizontal direction for each of the usual refractory bricks. Rather, it has proved sufficient if each third or fifth brick of the usual refractory bricks positioned vertically one above the other is anchored to the holding rod by an anchor. Light-weight refractory bricks are preferred for the usual refractory bricks as they permit a simpler construction due to their low weight. A second layer of light-weight refractory bricks can be arranged between the usual refractory bricks, preferably light-weight refractory bricks, and the holding rod, this improving the insulation and serving to protect the anchor.

The foot portion of the refractory front wall extends about over 1/5 to ⅓ of the height of the refractory front wall whereas the remaining part is formed by the usual refractory bricks, preferably light-weight refractory bricks.

A particularly advantageous construction of the foot portion composed of bricks of a high temperature bending strength is possible combined with a metal holding rod which has an anchor segment on its lower end which has a T-shaped anchoring rib on the ignition hood side in vertical direction and on its lower end, i.e.

on the sinter bed side, has a further T-shaped anchoring rib. A cast anchor segment is preferably used as anchor segment, which is attached to the metal holding rod by screw or casting connections. The anchor segment can also be a composite part of the holding rod. Then, one or several further bricks of a high temperature bending strength can be pushed onto the rib on the ignition hood side on such an anchor segment. The bottom light-weight refractory brick then lies with its floor surface on the upper surface of the last-mentioned brick with a high temperature bending strength. The multiple part construction of the bricks with high temperature bending strength in the foot portion has the advantage that damaged parts can be selectively replaced.

The subject of the invention is explained in more detail below by means of an embodiment.

Figure 1:
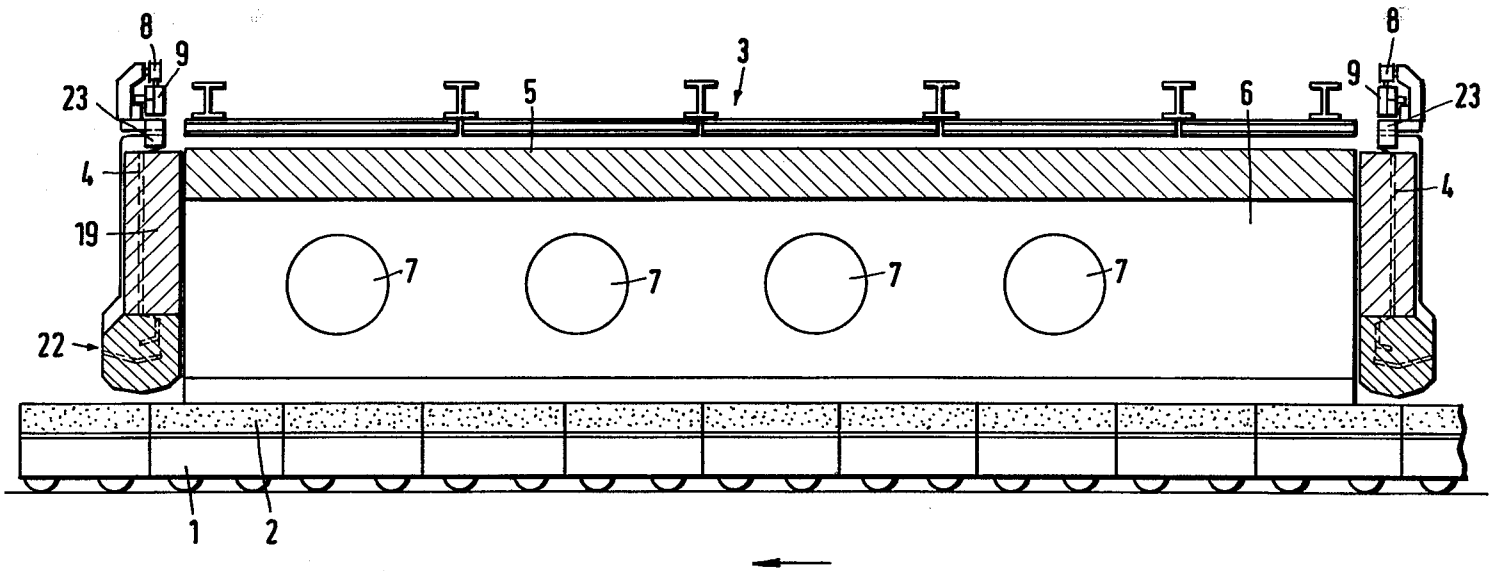
FIG. 1 shows a schematic representation of an ignition hood in longitudinal cross-section.

FIG. 1 shows the sintering belt 1 with the sintering material 2 lying thereon and the ignition hood 3. The ignition hood has a roof wall 5 and side walls 6. The burners 7 are arranged in the side walls 6. Each front wall 4 is suspended at its upper end on the transverse carrier unit 9 by means of rollers. The front wall is therefore shiftable transverse to the axis of the furnace.

Figure 2:
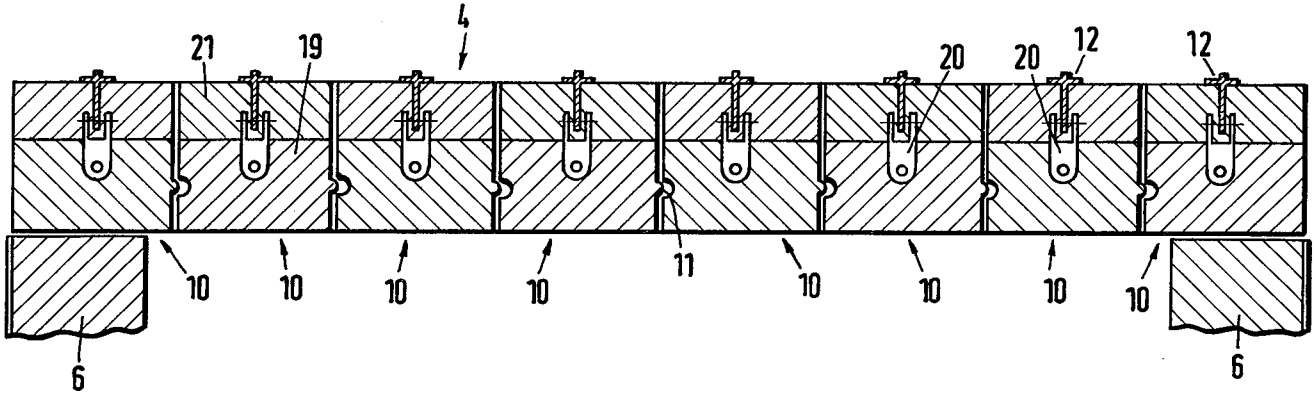
FIG. 2 shows a top view onto a section of FIG. 1.

As FIG. 2 in particular illustrates, the individual front wall 4 is composed of several vertical individual segments 10. The adjacent positioned individual segments intermesh by means of a groove/tongue arrangement 11.

Figure 3:
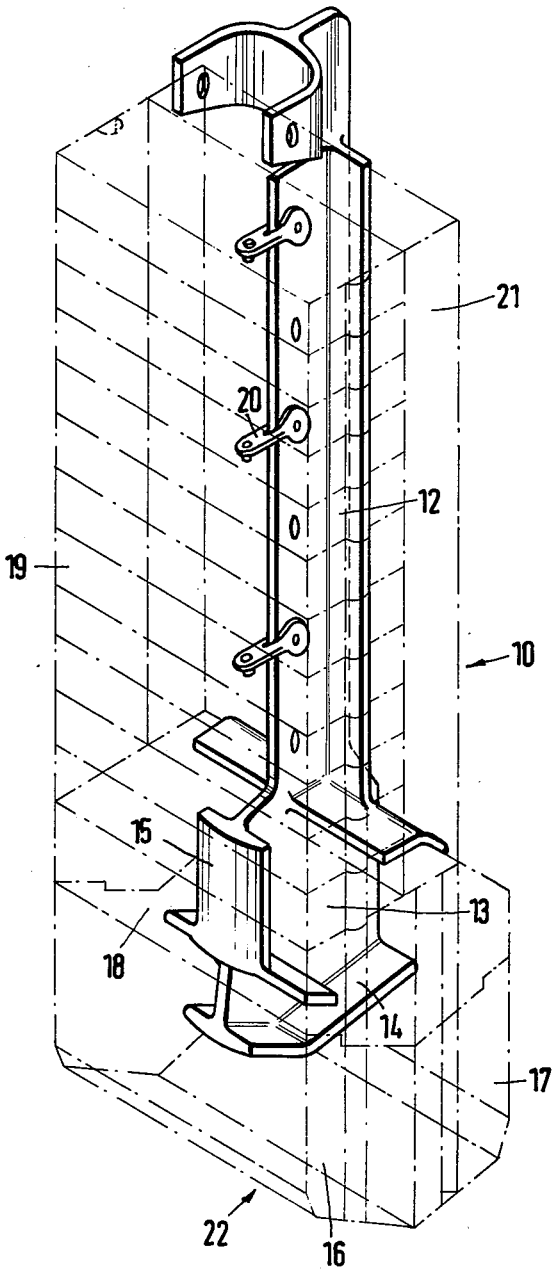
FIG. 3 shows a perspective representation of an individual segment on enlarged scale.

As FIGS. 1 to 3 show, each individual segment 10, has a metal holding rod 12 which has an anchor segment 13 on its lower part. The anchor segment 13 is a composite part of the holding rod 12 or is screwed or cast onto the holding rod 12. The anchor segment 13 has a T-shaped rib 14 extending in the direction of the sintering belt on its lower part, said rib 14 converging downwards in an approximate "V" shape. The two lower bricks 16 and 17 can be shifted onto this rib. Moreover, the anchor segment 13 has a substantially vertically extending T-shaped rib 15 on its front end (on the sinter furnace side), onto which rib 15 the brick 18 can be shifted. Bricks 16,17,18 have grooves corresponding to the T-shaped ribs 14,15. Bricks 16,17,18 should have a high temperature bending strength of at least 11.2 or 5.1 $N/mm^2$ at 1200° C. and 1300° C. respectively. The bricks extend about at the height of $\frac{1}{4}$ of the entire refractory front wall 4. The remaining upper part of the refractory front wall 4 is formed by light-weight refractory bricks 19 placed one above the other, which are held in horizontal direction by the U-shaped anchor 20 of the holding rod 12. A further layer with light-weight refractory bricks 21 is arranged between the light-weight refractory bricks 19 and the holding rod 12.

As FIG. 3 shows, only each fourth light-weight refractory brick 19 is secured on the holding rod 12 by means of an anchor 20. This has proved sufficient as the essential load of the light-weight refractory bricks is substantially received by the foot portion referenced as a whole as 22. The foot portion is composed of the anchor segment 13 and the bricks of high temperature bending strength 16–18. The front wall 4 composed of the individual segments is pressed against the side walls 6 and the roof wall 5 by usual pressure means or also by the suspension point 23 of the holding rod being selected in such a way that the front wall 4 abuts against the rest of the walls due to the force of gravity.

The essential advantages of the construction according to the invention are seen in the fact that a vertical front wall guarantees suspension which on the one hand has a long durability and on the other can be quickly and selectively repaired in the case of damages. Namely, if damage occurs in an individual segment 10, then it is simply necessary to shift the individual segments over the transverse carrier 9 in transverse direction and insert a prepared new individual segment 10 into the place of the damaged individual segment. With the same structure of individual segment 10 it is only necessary to shift the remaining individual segments present together after removing the damaged individual segment and to set the new individual segment on the edge, or, if it is suspended ready on the transverse carrier 9, to push it in. It is thus possible to change segments in a very short time. There is the additional advantage that in the construction with light-weight refractory bricks in the upper part a very cheap and simple assembly is guaranteed, whereby at the same time sufficient durability is provided by the bricks with high temperature bending strength even in the case of high heat load. The high-quality foot portion 22 guarantees the sufficient durability without water cooling. A further advantage is that, in contrast to the usual construction, of the ignition hood with inclined front wall, the problem of individual bricks being damaged by a shearing effect does not arise with the subject of the invention. The light-weight refractory bricks lie safely on the foot portion 22 without there being any danger of shearing effects even in cases of higher temperatures.

We claim:

1. Refractory vertically extending front wall for industrial furnaces, having means at the upper end of the front wall for movable support thereof to permit shifting of the front wall in a direction transverse to the axis of the furnace, comprising:

a plurality of individual intermeshing segments, each of said segments having a tongue and a groove portion, said tongue portion of one of said segments being receivable within said groove portion of a next adjacent segment but being free of connection with said next adjacent segment;

a holding rod for each said individual segment including anchoring means fixed thereto extending into a foot portion of the front wall; and, said several single segments being movable in relation to one another to provide for ease of interchange by virtue of said tongue and said groove relationship providing a fixed relationship between adjacent ones of said segments to prevent gas from passing between said adjacent segments while being free of a fixed connection therebetween to permit said holding rod together with its said individual segment to be removed and replaced by shifting of said segments in the direction transverse to the axis of said furnace.

2. Refractory wall as claimed in claim 1, for said industrial furnaces having a sintering belt wherein said anchoring means includes a first T-shaped rib converging downwards in an approximate "V" shape and extending on its lower part in a direction of the sintering belt, and a second T-shaped rib extending vertically from said holding rod.

3. Refractory wall as claimed in claim 1 or 2, including light-weight refractory bricks placed one above the other, and an anchor connected with some of said light-weight bricks and said holding rod for holding said light-weight bricks in a horizontal direction.

4. Refractory wall as claimed in claim 3, including an additional layer of light-weight bricks between said first-mentioned layer of light-weight bricks and said holding rod.

5. Refractory wall as claimed in claim 2, including bricks having a high temperature bending strength attached to said T-shaped ribs to form a foot portion of said refractory front wall, a first group of light-weight bricks which lie on said first-mentioned bricks and extend in a vertical direction, means connected with said holding rod for holding said first group of bricks in a vertical direction, and a second group of light-weight bricks held between said first group of light-weight bricks and said holding rod.

6. Refractory wall as claimed in claim 1, including a metal holding rod for each said individual segment, extending into a foot portion of the refractory front wall, said holding rod including an anchor segment on its lower end for anchoring the refractory front wall, and a first layer of refractory bricks having a high temperature bending structure forming the foot portion, said refractory front wall being built up by said bricks of high temperature bending strength which are attached on said anchor segment, and the remaining upper part of the refractory wall including usual refractory bricks lying on said foot portion in a vertical direction and held by said holding rod in a horizontal direction.

7. Refractory wall as claimed in claim 6, wherein said first group of bricks have a bending strength of 11.2 $N/mm^2$ at 1200° C. and 5.1 $N/mm^2$ at 1300° C.

8. Refractory wall as claimed in claim 6, wherein said anchor segment includes a T-shaped support bar and U-shaped anchor elements for securing said first layer of refractory bricks to said T-shaped support.

* * * * *